United States Patent [19]

Gühne

[11] 4,437,204

[45] Mar. 20, 1984

[54] VACUUM CLEANER HOUSING

[75] Inventor: Wieland Gühne, Remscheid, Fed. Rep. of Germany

[73] Assignee: Vorwerk & Co. Interholding GmbH, Wuppertal, Fed. Rep. of Germany

[21] Appl. No.: 360,499

[22] Filed: Mar. 22, 1982

[30] Foreign Application Priority Data

Apr. 11, 1981 [DE] Fed. Rep. of Germany ..... 3114752

[51] Int. Cl.[3] ..... A47L 9/00

[52] U.S. Cl. ..... 15/325

[58] Field of Search ..... 15/323, 339, 327 R, 15/327 F, 327 D, 325, 326, 350

[56] References Cited

U.S. PATENT DOCUMENTS

| | | | |
|---|---|---|---|
| 2,214,725 | 9/1940 | Ross | 15/325 X |
| 2,241,862 | 5/1941 | Langille | 15/325 |
| 2,941,231 | 6/1960 | Von Grumbkow | 15/325 X |
| 3,516,110 | 6/1970 | Nillsson | 15/326 X |
| 3,950,814 | 4/1976 | Fleischhauer | 15/327 E |

*Primary Examiner*—Chris K. Moore

*Attorney, Agent, or Firm*—Martin A. Farber

[57] ABSTRACT

A vacuum cleaner housing having a covering which cushions the side surfaces of the housing and is formed by a wall of semi-rigid material of a cap placed over the housing, the wall extending in self-supporting manner at a distance from the housing side walls, the cap being supported for longitudinal displacement in spaced position by a supporting rib. In this way effective protection against impact is obtained by simple means.

6 Claims, 3 Drawing Figures

VACUUM CLEANER HOUSING

The present invention relates to a vacuum cleaner housing having a handle mount and, opposite it, a socket as well as a covering which cushions the side surfaces of the housing.

In one known development, the vacuum cleaner housing is provided with a reinforcing steel insert and covered by a foam covering sprayed thereon. The latter in its turn is surrounded by a covering consisting of plastic. The advantage of such a development is in the protection against impact. However, the large amount of material required together with the higher cost of manufacture constitute disadvantages.

The object of the invention is to develop a vacuum cleaner housing of this type in such a manner that, with a saving of material, good protection against impact is still obtained without the stability of the vacuum cleaner housing being impaired.

This object is achieved by means of a covering comprising a wall of semi-rigid material in the form of a cap, the cap being placed on the housing from the socket side, the wall extending in self-supporting manner at a distance from sidewalls of the housing, the cap being centered in form-engaging manner on a cylindrical surface of the socket, the cap having an edge zone on the handle-mount side, the improvement further comprising a supporting rib disposed circumferentially about the housing, and the cap being supported for longitudinal displacement in spaced position by the supporting rib.

Thereby, there is provided a vacuum cleaner housing, the protection of which against impact can be obtained at an extremely favorable cost. Furthermore, the protection against impacts can be obtained with a saving of material so that the total weight of the vacuum cleaner housing can be reduced. This leads to easier handling of the vacuum cleaner. The covering, which is developed in the form of a cap, extends parallel to and spaced from the sidewalls of the housing, preferably maintaining a distance away of about 1 to 5 mm. One end of the cap surrounds the socket in a cooperatively shaped movement limiting manner, the socket being simultaneously used to center the cap, while the other end of the cap, namely, the edge zone on the handle side, is supported in spaced position for longitudinal displacement by a supporting rib. In this way compensation in length of the cap is possible if the cap should be deformed mechanically as a result of impact. The supporting rib may be a part either of the cap or of the vacuum cleaner housing. A separately applied supporting rib would also be possible. The material of which the cap is made and its formation are such that the cap always returns to its initial position. By suitable selection of the material of the cap and suitable dimensioning of the air gap, a variation with respect to the protection against impact can be effected. Furthermore, the cap is very effective in dampening noise.

One advantageous further development is characterized by an axial securing of the cap in the region of the latch opening of the socket. The latch opening, which is present in any event, thus fulfills a double function.

In this connection it has been found advantageous to provide in the cap wall, in the region of the insertion socket, an opening which is aligned with the latch opening in the socket and into which a resiliently depressible cup-shaped button for acting on and releasing the latch knob is inserted. A collar on the latch opening extends into the inside of the cup space. The release button, which extends into the opening in the cap wall, secures the axial position in both directions. Although the release button is made of flexible material, it is securely held by the collar which enters into the interior of its cup-shape. The upper edge of the collar then represents the flexure region of the release button.

Structural parts can be eliminated by forming the wall of the cap continuing around the front edge of the insertion, socket into a sealing lip which extends into the socket opening. Therefore an additional sealing lip which would also have to be attached can be dispensed with.

Another advantageous feature is that an integral forceheld bridge formed of a continuous section of the housing wall is provided between the handle and the socket. Blows on the cap are therefore not transmitted directly to the handle mount.

Finally, it is also advantageous for a facing strip to extend over the edge of the cap wall, serving to receive the housing end of the filter.

With the above and other objects and advantages in view, the present invention will become more clearly understood in connection with the detailed description of a preferred embodiment, when considered with the accompanying drawings, of which:

Figure 1:
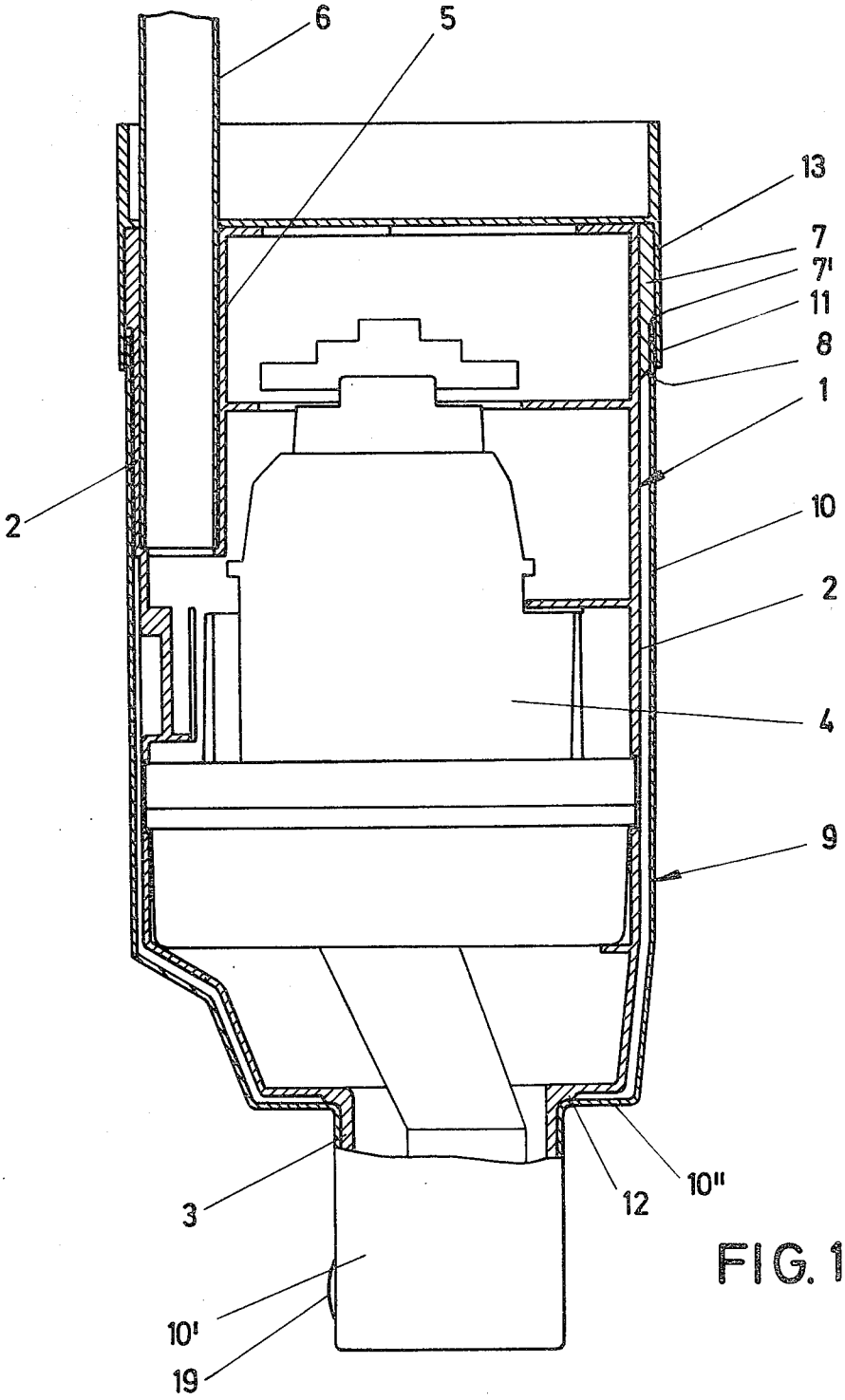
FIG. 1 shows, partly in elevation and partly in section, a vacuum cleaner housing covered by a cap.
Figure 2:
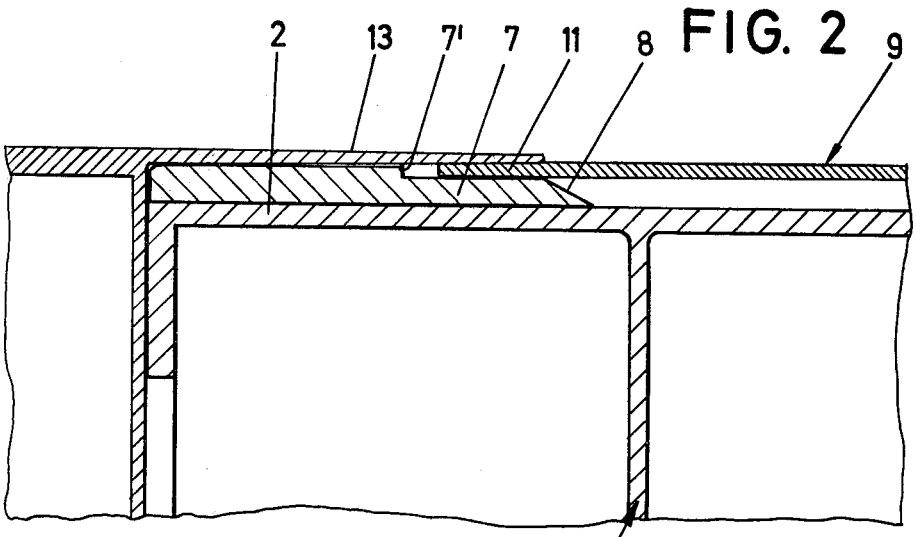
FIG. 2 is a longitudinal section through a vacuum cleaner housing in the region of the edge of the cap.

The vacuum cleaner housing 1 includes housing sidewalls 2 which terminate in a socket 3. Within the vacuum cleaner housing 1 there is a vacuum cleaner motor 4, shown diagrammatically. Furthermore, the vacuum cleaner housing 1, which is made of suitable plastic, has an internal handle mount 5 in the form of a bushing molded thereon. It receives, held by the cooperative shape of the respective parts, a handle 6, which continues in customary manner into a handle grip (not shown). In this way, a force-held one-piece bridge is created between the insertion socket 3 and the handle mount 5.

At its end opposite the socket 3, the vacuum cleaner housing 1 is provided with a circumferential supporting rib 7. The end thereof facing the socket 3 forms a run-on bevel 8.

A cap 9 which forms a covering is placed onto the vacuum cleaner housing 1. The wall 10 of the cap is made of semi-rigid material and is spaced from the housing walls 2. The edge zone 11 of the cap on the handle-mount side lies in longitudinally displaceable manner over the supporting rib 7. The easy placing-on of the edge zone 11 is assured by the run-on bevel 8 of the supporting rib 7.

The cap wall 10' which lies in the region of the socket 3 is centered in form-engaging manner (i.e., held to an extent in a movement limiting manner by the cooperative shape of the parts) on the cylindrical surface of the socket 3. This means that the air space between the self-supporting wall 10, the cap 9 and the housing sidewalls 2 ends in front of the socket 3. At that place the socket is provided at its throat with a collar 12 so that the cap wall 10'' which extends at right angles to the socket 3 is held at a distance from the vacuum cleaner housing 1; see FIG. 1.

The edge region 11 extends up to a distance in front of an edge 7' of the supporting rib 7 so that in the event of mechanical deformation of the cap 9, compensation in length is assured.

A facing strip 13 extends over the edge region 11 of the cap 9, forming the receiver for the housing-side end of a filter, not shown.

The wall 10' of the cap 9 which surrounds the socket 3 is extended around the front edge 14 (FIG. 3) of the socket 3 and continues there into a sealing lip 16 which extends into the socket opening 15. In this way the cap is axially secured in position in one direction.

For the additional securing of the cap 9 in both directions an opening 17 is provided in the cap wall 10' In the region of the socket 3. This opening is aligned with a latch opening 18 in the socket 3. Within the opening 17 there is inserted a cup-shaped button 19 which can be pushed resiliently inward and into the interior cup-shaped space 20 in which there penetrates a collar 21 extending from the socket 3. The cup edge 22 of the release button 19 continues into an outwardly directed flange 23 which is located below the edge region Z of the opening 17. The release button 19 is thus reliably secured in position.

Figure 3:
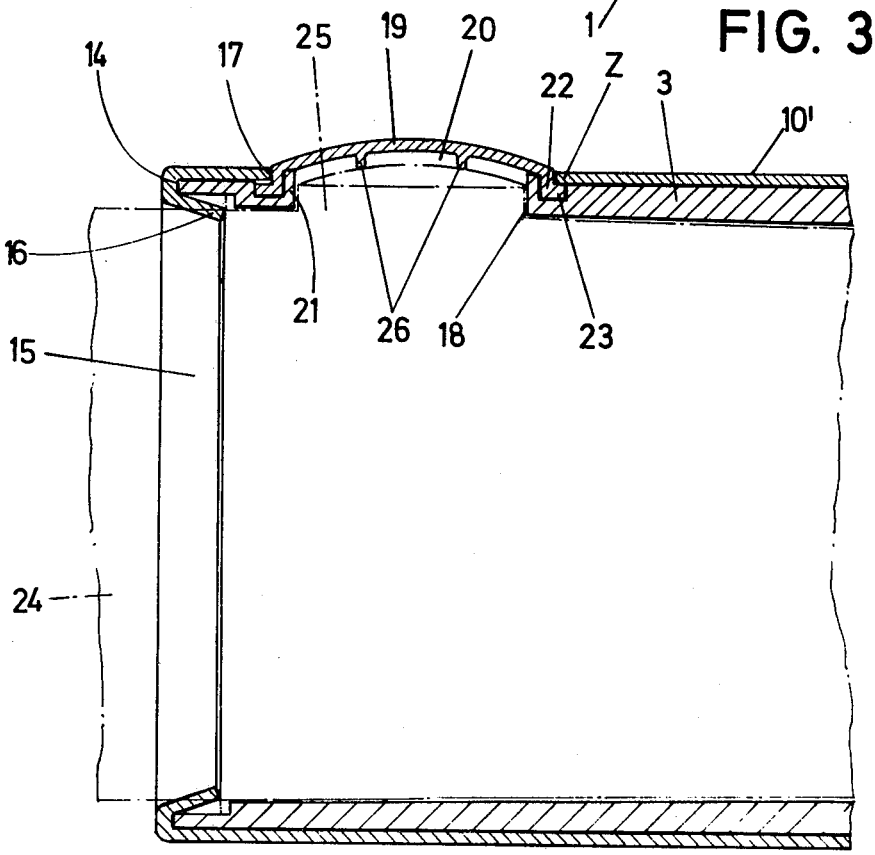
FIG. 3 is a longitudinal section through the insertion socket with cap wall surrounding it in in a self-holding manner.

If the connection socket 24 of a vacuum nozzle, as shown in dash-dot line in FIG. 3, is inserted into the socket 3, its locking (or latch) knob 25 engages into the latch opening 18 of the socket 3 which is surrounded by the collar 21. This socket 24 can be pulled out only after pushing in the flexible release button 19, its ribs 26, which extend on the inside of the cup down to the latch knob, moving the latch knob 25 into the released position.

I claim:

1. In a vacuum cleaner housing having a handle mount, a socket opposite said mount, and a covering which cushions side surfaces of the housing, the improvement wherein said covering comprises a wall of semi-rigid material in the form of a cap, said cap being placed on said housing from said socket, said wall extending in self-supporting manner at a distance from sidewalls of said housing, said cap being centered in form-engaging manner on a cylindrical surface of the socket, said cap having an edge zone on the handle mount side, the improvement further comprising a supporting rib disposed peripherally about said housing, and wherein said cap is supported for longitudinal displacement in spaced position by said supporting rib.

2. The vacuum cleaner housing as set forth in claim 1, wherein said socket is formed with a latch opening, and said cap is axially secured to said socket in the region of the latch opening of said socket.

3. The vacuum cleaner housing as set forth in claim 2, wherein said wall of the cap in the vicinity of said socket is formed with an opening aligned with said latch opening, the improvement further comprising a resiliently depressible cup-shaped button inserted in said opening of said cap wall, said button being deformable against a latch knob of a vacuum nozzle upon a positioning of said nozzle within said socket and being adapted when pressed to release said latch knob, said latch opening is defined by a collar extending into an inside of said button.

4. The vacuum cleaner housing as set forth in claim 1, wherein said socket has a front edge defining a socket opening, said wall of said cap is continued around said front edge of the socket and forms a sealing lip adjacent said front edge, said sealing lip extending into said socket opening of said socket.

5. The vacuum cleaner housing as set forth in claim 1, further comprising a continuous section of housing wall between said handle mount and said socket, said continuous section of housing wall being a force-held bridge between said handle mount and said socket.

6. The vacuum cleaner housing as set forth in claim 1, further comprising a facing strip disposed peripherally around said housing at an end remote from said socket, an edge region of said cap wall being insertable between said facing strip and said supporting rib to be covered by said facing strip, said facing strip being adapted to receive a housing-side end of a filter.

* * * * *